United States Patent [19]

Good

[11] 4,338,913

[45] Jul. 13, 1982

[54] SOLID FUEL BURNING STOVE

[76] Inventor: Lewis D. Good, 7579 100th St., Caledonia, Mich. 49316

[21] Appl. No.: 130,828

[22] Filed: Mar. 17, 1980

[51] Int. Cl.[3] ..... F24C 1/14

[52] U.S. Cl. ..... 126/77; 126/60; 126/83; 126/197; 126/307 A

[58] Field of Search ..... 126/79, 83, 121, 144, 126/60–66, 77, 192, 197, 307 A; 123/83

[56] References Cited

U.S. PATENT DOCUMENTS

| | | | |
|---|---|---|---|
| 63,926 | 4/1867 | Moore | 126/83 |
| 1,397,506 | 11/1921 | Farnes | 126/83 |
| 2,400,352 | 5/1946 | Higley et al. | 126/83 |
| 2,548,312 | 4/1951 | Kaufman | 126/83 |
| 3,168,088 | 2/1965 | Martin et al. | 126/77 |
| 4,008,708 | 2/1977 | Robertson | 126/121 |
| 4,111,181 | 9/1978 | Canney | 126/77 |
| 4,117,824 | 10/1978 | McIntire et al. | 126/77 |
| 4,127,100 | 11/1978 | Baker | 126/61 |
| 4,149,671 | 4/1979 | Cagle | 126/110 R |
| 4,157,704 | 6/1979 | Zimmer | 126/62 |
| 4,184,473 | 1/1980 | McIntire et al. | 126/77 |
| 4,192,285 | 3/1980 | Nietupski | 126/83 |
| 4,196,713 | 4/1980 | Blankenohip | 126/83 |
| 4,201,185 | 5/1980 | Black | 126/83 |
| 4,212,286 | 7/1980 | Shane et al. | 126/77 |

OTHER PUBLICATIONS

Timberline TM Stove Catalog, Manufactured by Independent Energies, Inc., Schoolcraft, Michigan 49087

*Primary Examiner*—Samuel Scott
*Assistant Examiner*—Lee E. Barrett
*Attorney, Agent, or Firm*—Varnum, Riddering, Wierengo & Christenson

[57] ABSTRACT

A solid fuel burning stove (10) includes a firebox (11) having an insulated bottom chamber in which fuel is burned. The bottom chamber includes an insulated bottom surface (72) and walls (18, 20, 22, 24) which provides for heat retention when fuel is burned therein thereby creating high temperatures. The bottom chamber of the firebox (11) is divided from a top chamber by a horizontally extending baffle (46) which directs flow of exhaust gases from the bottom to the top of the firebox (11). The exhaust gases are burned in the top portion of the firebox (11) by means of the heat generated within the lower chamber and the introduction of fresh combustion air. This fresh combustion air is drawn in through an orificed pipe (49) extending along the length of the firebox. After the gases are burned in the top portion of the stove (10), they are communicated to a heat saver (42) including an inverted V-shaped flow diverter (64) which reduces the velocity of the exiting gases and provides for greater recovery of heat therefrom. The stove in accordance with the invention provides for a two-stage burning process wherein solid fuel is burned in the first stage and the volatile gases released by the fuel are burned in the second stage. In this way, the fuel is consumed in a most efficient manner.

22 Claims, 8 Drawing Figures

SOLID FUEL BURNING STOVE

BACKGROUND OF THE INVENTION

1. Field of the Invention

The present invention relates to a solid fuel furnace having an insulated firebox providing a two stage heating process wherein solid fuel is burned in a first chamber and volatile gases released by the fuel are burned in a second chamber.

2. State of the Prior Art

Furnaces and stoves in which solid fuel such as wood blocks and the like are burned have enjoyed great success. Such stoves have often included an insulated chamber in which fuel is placed and a means for providing combustion air to the chamber. Typically, this combustion air is brought underneath a grate on which the fuel is laid, with the air drawn into the stove through a forced air system. It is also known that if a high temperature can be maintained within a furnace, volatile gases released by the fuel during burning may be combusted to thereby add to the efficiency of the heating process.

One such stove which burns volatile gases released by the burning fuel is disclosed in the Canney U.S. Pat. No. 4,111,181, issued Sept. 5, 1978. The U.S. Pat. No. 4,111,181 discloses a wood burning stove including a grate on which fuel is placed wherein primary combustion air is introduced from beneath the grate. A smoke shelf or baffle is provided within the stove to direct gases released by the burning fuel to a secondary chamber through a plurality of tubes. In this secondary chamber, additional air is provided for burning of the gases. In this way, a more efficient stove is provided since the volatile gases are burned before being released to the atmosphere.

The Zimmer U.S. Pat. No. 4,157,704, issued June 12, 1979, shows a fireplace stove including a conventional grate on which wood is burned wherein combustion air is brought up from beneath the grate. The bottom portion of the stove may be provided with a firebrick lining in order to provide a structure resistant to high temperatures. Similar to this is the stove shown in the McIntire et al U.S. Pat. No. 4,117,824, issued Oct. 3, 1978, including a bottom portion provided with a plurality of firebricking which form a trough-like structure for supporting fuel thereon.

The Cagle U.S. Pat. No. 4,149,671, issued Apr. 17, 1979, discloses a solid fuel furnace including a forced air supply for providing combustion air underneath a grate which supports wood blocks or the like. The furnace shown in U.S. Pat. No. 4,149,671 provides heat by passing an air supply in a heat exchange relationship through baffles disposed about the fuel burning area. The Baker U.S. Pat. No. 4,127,100, issued on Nov. 28, 1978, discloses a wood burning stove which may be lined with firebrick to provide resistance to high temperatures generated by burning of the fuel. The heat given off by the fuel is passed in a heat exchange relationship with a pipe carrying ambient air to thereby heat the air and provide a source of heat in addition to that radiated by the stove.

The Morton et al U.S. Pat. No. 3,168,088, issued Feb. 2, 1965, discloses a stove including a grate for supporting logs or the like thereon, wherein the combustion chamber includes a damper device for controlling air flow to the fuel. The damper operates in response to the temperature inside the combustion chamber.

As can be seen from the foregoing, solid fuel burning stoves which attempt to increase the efficiency of the heating process by burning combustion gases released by the fuel have been used in the past. One problem with such stoves is that the temperature generated within the combustion chamber was often not sufficient to burn these gases. Additionally, the use of grates to support the fuel required a supply of combustion air provided beneath the grate. This type of air intake would often cool gases already present in the chamber and force the hot gases to the top of the stove and thereby reduce any burning thereof. Other methods of burning such volatile gases released by the fuel necessitated a complex recirculation pipe and forced air drafts in order to provide sufficient heat and air to burn the volatile gases.

SUMMARY OF THE INVENTION

In accordance with the invention, a stove includes a firebox including side and top walls and a solid base for supporting fuel thereon. The walls of the stove are lined with a refractory material such as firebrick to provide resistance to heat. In order to increase the heat retention capability of the stove, the firebricking may be lined with an insulating liner, such as asbestos, which reduces heat transmission through the firebrick to the walls of the stove and reflects some of the heat generated into the interior of the stove. The firebox includes a first combustion chamber in which wood or other solid fuel is burned and an air supply for burning the fuel. A baffle or like structure is provided within the firebox to separate this first combustion chamber from a second combustion chamber in which gases released by the fuel are burned. The baffle directs the flow of the volatile gases from the first chamber to the second chamber, which also includes a separate air supply. In this way, the efficiency of the burning process is increased by providing for burning of both the solid fuel and gases released thereby in a simple manner.

In order to increase the temperature within the combustion chambers of the firebox, the bottom surface thereof, is formed by a solid sheet on which the fuel is placed. Beneath this solid sheet may be an insulating layer or the like. No combustion air is provided from beneath the fuel so that the bottom surface of the firebox is maintained at an extremely high temperature which may approach 1500° to 2000° F. The lined refractory material disposed about the walls of the firebox also provides for an increased temperature within the primary combustion chamber.

Combustion air is provided to the fuel by means of a natural draft air intake system. The lower chamber of the firebox in which the solid fuel is burned includes an adjustable port which allows air to enter across the fuel in countercurrent flow to the direction of gas flow released during burning. Combustion air is provided to the secondary chamber in which the volatile gases are burned by means of an orificed pipe which extends along the length of the chamber. This pipe has an inlet in communication with the atmosphere so that a natural draft is provided therethrough to supply combustion air which flows countercurrent to the direction of flow of the volatile gases. This countercurrent flow arrangement is provided by the baffle which separates the first and second combustion chambers.

The baffle may be operatively connected to a hopper door through which fuel is supplied to the stove so that when the door is opened, the baffle is raised, thereby relieving pressure within the firebox and reducing the risk of explosion.

In order to reduce the velocity of gases exiting the stove and therefore increase the radiation of heat therefrom, a baffle-like heat saver is disposed at the outlet of the stove. This heat saver includes an inverted V-shaped flow diverter which reduces the velocity of exhaust gases and allows for greater recovery of heat during passage from the stove to a smoke outlet. The exhaust gases are typically maintained between 300° to 600° F. depending upon the type of fuel burned within the stove.

BRIEF DESCRIPTION OF DRAWINGS

The invention will be described with reference to the accompanying drawings wherein the like members bear like reference numerals in which.

DETAILED DESCRIPTION OF THE DRAWINGS

Figure 1:
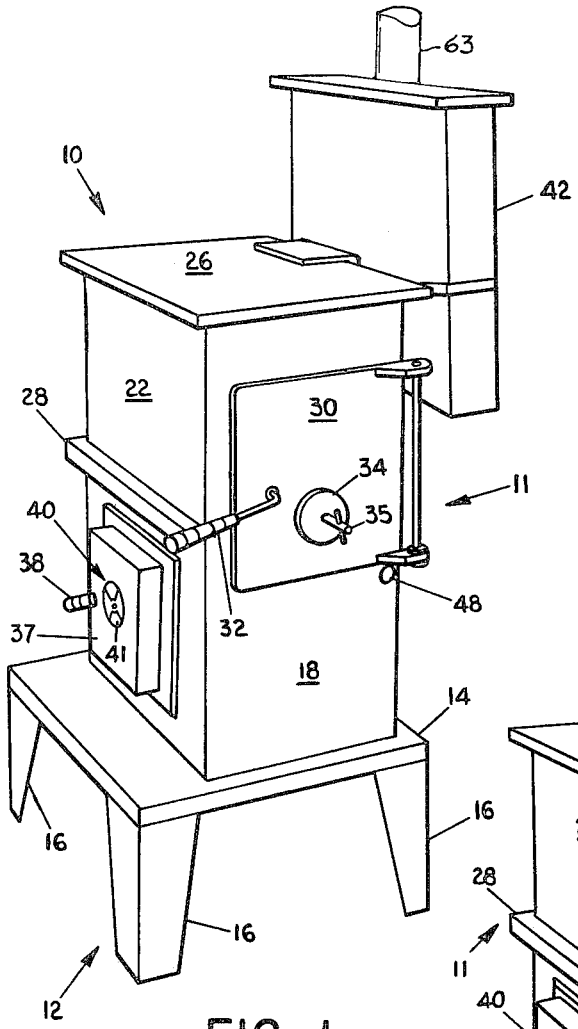
FIG. 1 is a perspective view of the stove according to the present invention.

With reference to FIG. 1, a solid fuel burning stove 10 comprises a base 12 and a firebox 11 mounted on the base 12. The base 12 includes a horizontally disposed platform 14 and upright legs 16 disposed at the corner portions thereof. The platform and legs may be made of cast iron or steel.

The firebox 11 includes a front wall 18, rear wall 20, side walls 22 and 24 and a top plate 26 all arranged in a generally rectangular configuration. Disposed about the midsection of the side walls 22 and 24 is a flange 28 which extends outwardly from the walls to add rigidity to the firebox as well as providing a heat exchange type fin. All of the walls of the stove and the flange 28 are preferably made of cast iron.

Front wall 18 includes a pivotally mounted door 30 which provides access to the top portion of the firebox 11. The door 30 includes a latch which is operated by a handle 32 extending parallel to the plane of the front wall 18. The handle 32 may include a ribbed or fin-type configuration which promotes radiation of heat conducted by the handle into the atmosphere. The door 30 may also include an adjustable front air intake valve 34. The valve 34 includes a disc portion 35 which is mounted on a threaded member 36. The disc portion 35 is disposed over an aperture in the door 30 so that adjustment of the threaded member 36 displaces the disc 35 and thereby adjusts the opening in the door 30 to regulate air intake into the top portion of the firebox.

The side wall 22 includes a door 37 hingedly mounted to the wall. The door 37 includes a latch operated by a handle 38 which includes fins or ribs similar to that described above with reference to handle 32 so as to promote radiation of heat conducted by the handle. Door 37 includes an adjustable air intake 40 which regulates air flow into the lower portion of the firebox 11. The air intake 40 comprises a disc 41 which is pivotably mounted on the door to selectively cover apertures therein and thereby regulate air intake into the lower portion of the firebox. Disposed at the upper portion of the firebox 11 and in communication with the interior thereof is a baffle structure or heat saver 42 which operation will be described below.

Figure 2:
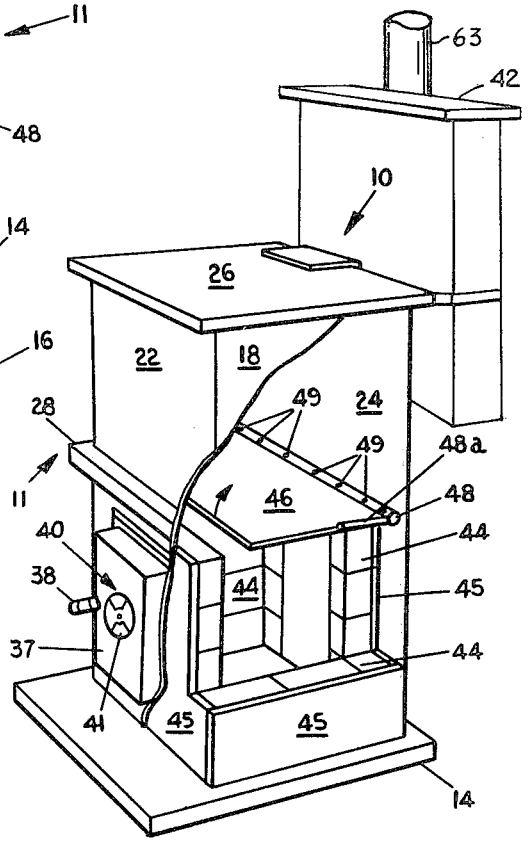
FIG. 2 is a persepective view of the firebox shown in a partial cutaway view wherein the firebrick lining and the baffle structure in accordance with the invention are shown.

Turning to FIG. 2, the firebox 11 is mounted on platform 14 of the base. The interior of the lower portion of the firebox 11 is lined with firebrick 44 which provides a heat-resistant chamber for retaining heat generated during burning of fuel within the firebox. The firebrick 44 may be formed of a castable refractory and provides some insulation of the lower portion of the firebox 11 as well as providing a durable interior surface which will not destruct when subjected to high temperatures which occur during burning of fuel. In order to increase the heat retaining capacity of the firebrick 44, the back surface of these bricks are preferably lined with an asbestos liner 45 or a similar type insulating material. This asbestos liner 45, which may have a thickness of $\frac{1}{4}$ inch, increases the insulating capacity of the firebrick 44 by providing a second layer of insulation between the fire and the walls of the firebox. In addition, the liner 45 reflects some of the heat generated by the fuel inwardly to the fire to increase the temperature inside the firebox 11. In this way, an extremely high temperature can be maintained within the burning chamber of the firebox 11.

Disposed at approximately the midsection of the firebox 11 is a baffle 46 which is preferably made of stainless steel to withstand the high temperatures generated during burning of fuel inside the stove. The baffle 46 may rest on the top portion of the firebrick 44 so as to divide the firebox into an upper and lower chamber. The portion of the baffle 46 adjacent side wall 22 is spaced therefrom to allow for passage of gases from the lower portion of the firebox into the upper portion. In this way, a pattern of gas flow can be established through the firebox 11. The baffle 46 is positioned between air intakes 34 and 40 so that the upper and lower chambers of the firebox each have a separate air supply.

The portion of baffle 46 adjacent side wall 24 is secured to pivot axis 48 which may be in the form of a hollow pipe including orifices 49 therein. The pipe 48 has an open end in communication with the atmosphere through the front wall 18 of the firebox so that a natural draft intake is provided through the pipe. The pipe 48 has ends 48*a*, also with orifices, which extend along the baffle toward the free end thereof. The orifices 49 provide a jet-like flow of combustion air to the upper portion of the firebox 11. Air drawn in through the pipe 48 is preheated since the pipe 48 is positioned over the fire zone of the stove 10. This preheating promotes combustion in the upper chamber of the stove.

Figure 3:
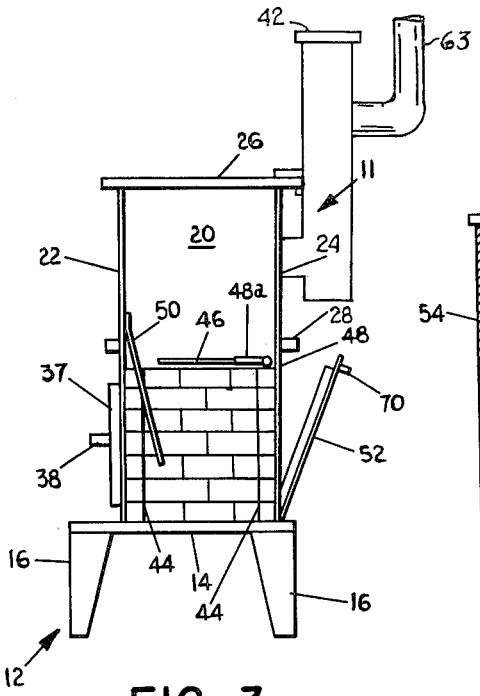
FIG. 3 is an end view of the firebox with the front wall 18 removed showing the interior thereof.

As shown in FIG. 3, the interior of the firebox 11 includes a grate 50 disposed adjacent the side wall 22. The grate 50 extends to a position adjacent the air intake at door 37. The grate 50 is preferrably made of stainless steel in order to withstand the high temperatures generated within the stove. Disposed in sidewall 24 is a pivotably mounted door 52 through which fuel can be added to the stove. The door is typically pivoted at the bottom portion thereof so that when in an open position the door forms a hopper. The mechanism for opening door 52 is linked to that for pivoting baffle 46, which operation will be described below with reference to FIG. 5.

Figure 4:
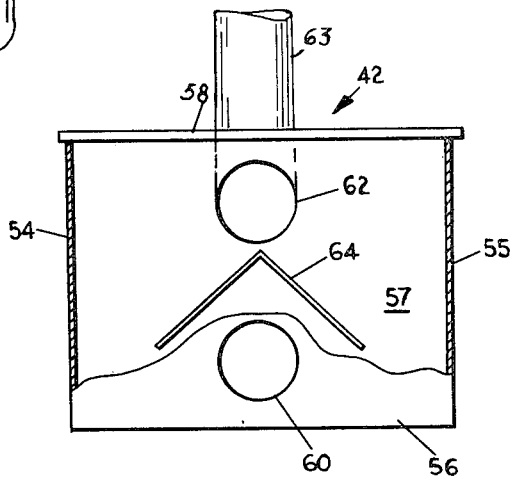
FIG. 4 is a partial cross-sectional view of the heat saver taken along lines 4—4 of FIG. 1.

FIG. 4 shows the baffle or heat saver structure 42 disposed at the top portion of the stove in communication with the interior thereof. This baffle or heat saver 42 serves to reduce the velocity of exhaust gases exiting from the firebox 11 and thereby increase the temperature within the stove as well as providing for additional radiation of heat into the atmosphere. The heat saver 42 has a generally rectangular configuration including side walls 54 and 55, front wall 56, rear wall 57 and a top plate 58. The top plate 58 includes an extending flange portion 59 which provides an additional heat exchange-like fin for increasing radiation of heat to the atmosphere. The heat saver 42 includes an intake 60 in communication with the upper portion of the firebox 11 and an exhaust 62 which communicates with a chimney pipe 63 or the like. Disposed within the heat saver 42 is an inverted V-shaped baffle 64 which directs exhaust gas flow about the baffle and to the exhaust 62. In this way, the velocity of the exhaust gases is reduced. This reduction in velocity of the exhaust gases cools the gases so that a more efficient chimney draft is provided.

Figure 5:
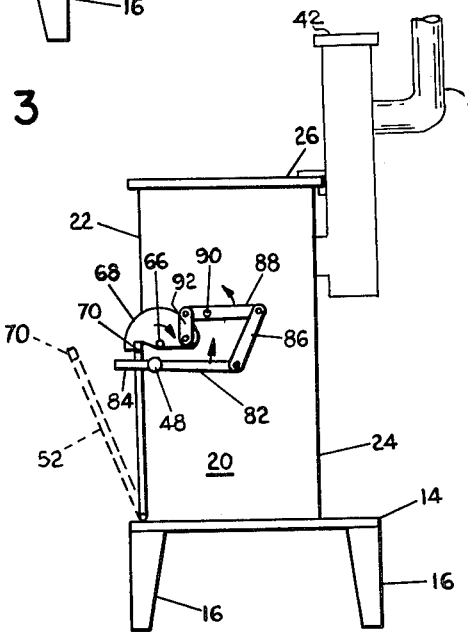
FIG. 5 is a rear view of the stove showing the linkage for operating the baffle and the hopper door in accordance with the invention.

With reference to FIG. 5, the linkage mechanism which operates door 52 and raises and lower baffle 46 is shown. The interconnection between the door 52 and the baffle 46 is provided for safety reasons. If the baffle was fixed in the horizontal position when the door 52 is opened, the intense heat and influx of air through the door 52 may cause an explosion. By raising the baffle 46 at the same time the door 52 is opened, the heat is somewhat dissipated and the gases within the firebox 11 are permitted to exhaust to the heat saver 42 and out through the chimney pipe. The mechanism for operating the door 52 and baffle 46 in conjunction includes a latch 68 pivotably mounted at pin 66 to the side of the stove. One end of the latch 68 engages a pin 70 disposed on door 52. A linkage 82 having a handle 84 is secured to the pipe 48 for rotational movement therewith. A link 86 is connected to one end of link 82 and to another link 88 which is pivotably mounted to the stove side through pin 90. The other end of the link 88 is connected to the latch 68 through another link 92. Thus, as the handle 84 is pivoted downwardly to raise the baffle 46, the latch 66 is rotated in a clockwise direction as viewed in FIG. 5 to release the pin 70 from engagement with the latch 68. Other forms of linkage mechanisms may be substituted for that shown to interconnect the operation of the baffle 46 and the feed door 52.

Figure 6:
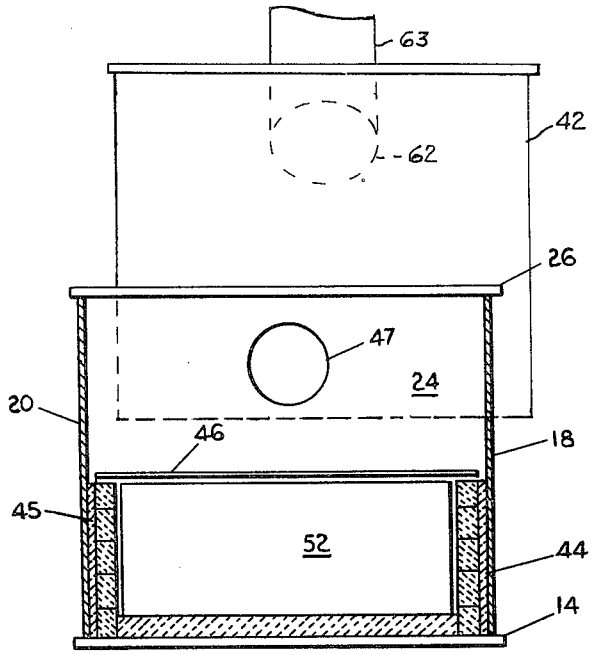
FIG. 6 is a cross-sectional view of the firebox along lines 6—6 of FIG. 3.
Figure 7:
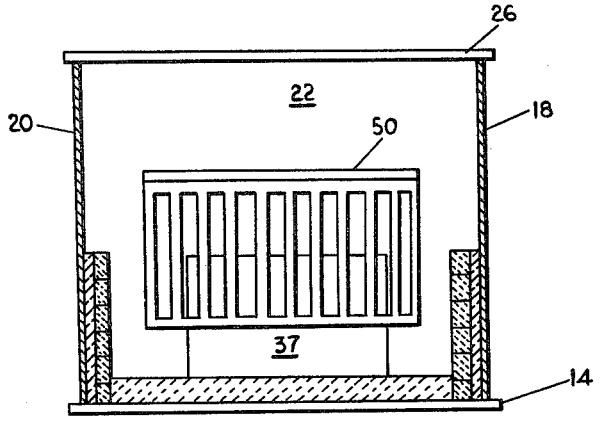
FIG. 7 is a cross-sectional view of the firebox taken along lines 7—7 of FIG. 3.

FIGS. 6 and 7 are cross-sectional views of the interior of the firebox 11 showing the positions of the hopper door 52 and the stainless steel grate 50 in relation to the baffle 46 and the firebrick 44. As can be seen, the firebrick 44 and the baffle 46 define a lower chamber in which fuel is disposed to be burned. As can be seen in FIGS. 6 and 7, the firebrick is placed only about the upright walls of the firebox and no firebrick is provided on the bottom surface thereof. If door 37 is opened, the grate 50 provides a fireplace-like effect.

Figure 8:
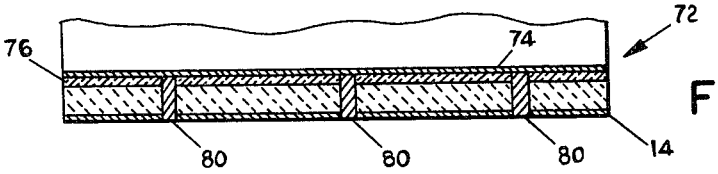
FIG. 8 is a detailed cross-sectional view taken along lines 8—8 of FIG. 7 showing the base portion of the firebox.

Turning to FIG. 8, the bottom portion of the firebox 11 comprises a bottom plate 72 which is preferably made of stainless steel. The stainless steel plate 72 is able to withstand the high temperatures generated during burning of fuel within the stove. Beneath the stainless steel plate 72 may be provided one or two layers of insulating type material. If one layer of insulation is used, an asbestos-type blanket 76 or the like is placed between the plate 72 and the platform 14 of the stove. The blanket preferably has a thickness of $1\frac{1}{4}$ inches. In order to prevent crushing of the insulation 76 due to the weight of the fuel loaded on plate 72, a plurality of supports 80 may be provided between the plate 72 and the platform 14. If additional information insulation is needed below the stainless steel plate 72, a firebrick-type material 78 may be placed beneath the stainless steel plate 72. These layers of insulation 76 and 78 provide for a temperature resistant bottom surface on which fuel is disposed so that the fuel is burned efficiently at a high temperature. The combination of the insulated bottom surface and the firebrick 44 along the side walls of the firebox 11 provides a chamber in which fuel may be burned at an extremely high temperature.

In operation, the stove provides an efficient source of heat by means of the two stage heating process. The temperature maintained in the stove is high enough to burn the volatile gases released by the wood fuel during burning in the lower chamber of the firebox. Fuel is placed in the lower portion of the firebox through the hopper door 52. This lower portion of the firebox is insulated by the firebrick and asbestos lining disposed about the walls and by the stainless steel bottom plate including the underlying insulation. The insulation retains heat generated by the fuel so that temperatures created by burning of the fuel may reach and exceed 1500° F.

In placing the air intake for the lower firebox chamber on wall 22, the airflow in the chamber is countercurrent to the movement of the fuel through the firebox. In this way, combustion air is preheated by passing over burning fuel before reaching the opposite end of the chamber wherein fresh fuel is placed. This preheating of combustion air also increases the efficiency of the burning process. Additionally, the baffle 46 disposed in the chamber causes gases released by the burning fuel to flow opposite to the direction of the incoming combustion air and over the already burned fuel. In this way, some burning of the volatile gases occurs in the lower firebox chamber. The gases which are not burned are maintained at a high temperature so that combustion is possible upon mixing with a fresh source of combustion air, which occurs in the secondary combustion chamber disposed above the baffle 46. By maintaining the temperature of these unburned volatile gases at a relatively high temperature, burning of these gases is made possible. The volatile gases typically comprise hydrocarbons released upon burning of the wood. In distinction, prior known stoves wherein the gases released by the burning fuel rise and cool would inhibit combustion of these gases since the temperature could not be maintained at a level which will permit burning.

Additionally, the use of a solid plate for supporting the fuel maintains the bottom portion of the stove at a relatively high temperature. The fact that the fuel is supported on a solid member as opposed to a grate also increases the efficiency of the burning process in that combustion air is not drawn from beneath the grate so as to cause the gases given off by the fuel to rise in the stove and thereby prevent burning of these gases. The baffle 46 also increases the efficiency of the stove by retaining the volatile gases in the burning zone until they are sufficiently heated so that upon passing to the secondary chamber and mixing with a fresh source of combustion air burning of these gases is possible.

When the volatile gases pass between the baffle 46 and side wall 22 to the upper combustion chamber, they are burned upon mixing with a fresh source of combustion air supplied through orificed pipe 48. The air supplied through this pipe is preheated since the pipe is placed over the burning zone in the primary combustion chamber. Additionally, this air is supplied in the form of discrete "jet" sprays emitting from the orifices in the pipe which to some extent turbulizes the volatile gases and increases burning thereof.

After burning in the secondary chamber, exhaust gases generated within the stove pass through the heat saver 42 which includes a flow diverter or baffle to reduce the velocity of the gases. The heat saver, by reducing the velocity of exhaust gases, causes the gases to be retained in the upper portion of the stove and thereby allows recovery of additional heat from these gases before passing through the chimney or smoke outlet. Typically, the gases exiting from the stove after passing through the heat saver are at a temperature of 400° F. The range of temperature of the gases exiting the stove is between 300° to 600° depending upon the type of fuel burned and the amount of air supplied to the stove.

The above-described stove has a relatively large surface area which promotes radiation of heat generated by burning of fuel therein. This large radiating surface permits the stove to heat a large room or even a house if appropriate duct work is provided to communicate the hot air to other portions of the house. In addition to the large surface presented by the walls of the stove, the midsection thereof and the top plate include extending flanges forming a fin which also promotes heat exchange to the atmosphere. If it is desired, additional extending flanges or fins may be provided to increase the radiative capacity of the stove. This large radiating area eliminates any need for providing separate heat exchanger pipes to transmit heat to an ambient air source.

Although it is likely that solid wood blocks or logs would be burned in the stove, other types of fuel can be used such as compacted leaves, grass, straw, sawdust logs and the like. Additionally, chips such as that generated by debarkers at sawmills could also be used in the stove. The intense heat generated by the stove causes the fuel to take on charcoal-like characteristics so that intense heat is generated without production of a large quantity of waste materials such as ash. By creating an intense heat zone of approximately 1500° or higher in the lower portion of the stove, the fuel burned therein is reduced to klinker-like formations instead of the usual ash deposits. These klinker-like deposits reflect the high heat generated by the stove which promotes efficient and complete burning of the fuel.

The linkage which connects the hopper door and the baffle within the stove also provides a useful safety feature. If the baffle is allowed to remain in a horizontal position when the hopper feed door is opened, a person would be exposed to intense heat and the exhaust gases which exit from the lower portion of the stove. In some cases, this onrush of gases may cause a small explosion. By raising the baffle at the same time the door is opened, these gases are allowed to rise in the stove through the chimney or smoke outlet and thereby reduce the risks of explosion. Also, smoke generated within the stove would rise to the chimney instead of exiting through the hopper door when feeding fuel to the stove.

Another advantage of the stove is that it operates on a natural draft system wherein all combustion air is drawn in through the air intakes without needing fans or the like. This is in distinction to prior known stoves which require the use of a forced-air system in order to provide the necessary combustion air to generate high temperatures within the stove. The firebox described above can achieve high temperatures by use of the insulated chamber and the two stage process in which solid fuel is burned in a first stage and gases released by the fuel are burned in a second stage. Further, this natural draft system allows the fire to take what it needs to support slow, steady combustion of the fuel. The remainder of the air passes up the chimney.

The combination of the well insulated firebox, the rear loading door, the front air flow vent, the baffle and the air pipe 48 provide an unusually efficient solid fuel burner. The high heats generated in the firebox burn very green wood with a minimum of smoke. It is believed that the high temperatures result in the cracking of the water to hydrogen and oxygen and cracking of the tars in the solid fuel so that essentially complete combustion takes place. The firebox stays so hot that relighting of the fire in the morning is unnecessary. Fresh wood begins burning upon placement in the firebox. After these very high temperatures are reached the wood burns continuously with little or no attention. At these high temperatures, the efficiency is estimated at 75% or better.

The foregoing is merely illustrative of one embodiment of the invention and is not intended to limit the invention to the above description and drawings. Changes and modifications which are obvious to one skilled in the art may be made without departing from the scope and nature of the invention which is defined by the appended claims.

The embodiments of the invention in which an exclusive property or privilege is claimed are defined as follows:

1. A solid fuel burning stove comprising:

a firebox including side, end and top walls and a base for supporting fuel thereon, said walls and base defining an enclosed body;

said firebox including refractory means disposed about a portion of said side and end walls for inhibiting heat transmission therethrough;

a primary combustion chamber in which said fuel is burned, said primary chamber having primary air intake means for supplying combustion air to said chamber;

a secondary combustion chamber in communication with said primary combustion chamber, said secondary chamber having secondary air intake means for supplying combustion air to said chamber so that volatile gases released by fuel burned in said primary combustion chamber are burned therein;

said secondary air intake means supplying combustion air to said volatile gases;

baffle means for directing flow of combustion air across the top of fuel in said primary chamber for combusting fuel therein and mixing with said volatile gases and for controlling the flow of said volatile gases from said primary combustion chamber to said secondary combustion chamber;

said baffle means being a horizontally disposed sheet extending across said firebox so as to define said first and second combustion chambers in said firebox;

said baffle means directing said volatile gases across said fuel burning in said primary combustion chamber to thereby maintain said gases at a high temperature; and means for regulating exhaust gas flow from said secondary chamber to a smoke outlet, said means including a flow diverter which reduces the velocity of the exhaust gases to thereby increase the amount of heat recovered from the gases when exiting the secondary chamber;

wherein burning of said hot volatile gases in said secondary chamber provides an additional source of heat for radiation by said firebox, thereby increasing the thermal efficiency of the fuel burned therein.

2. The stove of claim 1 wherein said firebox includes heat-exchange fin means for increasing the radiative capacity of the firebox.

3. The stove of claim 1 wherein said base comprises:

a high-temperature resistant surface on which said fuel is supported, said surface being a solid body; and insulation means below said surface to inhibit heat transmission therethrough.

4. The stove of claim 3 wherein said high-temperature resistant surface is a stainless steel sheet.

5. The stove of claim 4 wherein said base further includes a refractory material disposed between said surface and said insulation means, thereby providing additional resistance to heat generated by burning of said fuel.

6. The stove of claim 1 wherein said refractory means includes ceramic material which lines the interior surfaces of said side and end walls.

7. The stove of claim 6 wherein said ceramic material includes an insulation layer disposed between the brick and the surface of the wall, thereby reducing heat transfer therethrough.

8. The stove of claim 7 wherein said insulation layer is made of asbestos.

9. The stove of claim 1 wherein said primary combustion chamber is the portion of said firebox below said baffle means.

10. The stove of claim 9 wherein said refractory means is disposed entirely in said primary combustion chamber.

11. The stove of claim 10 wherein said refractory means extends upwardly to said baffle means, thereby defining a high-temperature resistant chamber.

12. The stove of claim 11 wherein said primary air intake means includes adjustable port means for admitting air to said primary combustion chamber, said air in counter-current flow to the direction of flow of gases released by burning of said fuel.

13. The stove of claim 12 wherein said adjustable port means is disposed on an access door to said primary combustion chamber.

14. The stove of claim 1 wherein said secondary combustion chamber is the portion of said firebox above said baffle means.

15. The stove of claim 14 wherein said secondary air intake means includes orificed pipe means extending along the length of said secondary chamber, said pipe means having an intake communicating with the atmosphere, whereby air is provided at a pressure greater than the pressure in said secondary chamber so as to induce a natural draft air intake.

16. The stove of claim 15 wherein said pipe means supports said baffle means in said firebox, said pipe means pivotally mounted to said firebox.

17. The stove of claim 15 wherein said secondary air intake means further includes adjustable valve means for supplying additional combustion air to said secondary combustion chamber, said valve means communicating atmospheric air to said chamber through a port in one of said walls.

18. The stove of claim 1 wherein said sheet is a stainless steel sheet.

19. The stove of claim 1 wherein said sheet is pivotally mounted in said firebox.

20. The stove of claim 19 wherein said firebox includes a feed door through which fuel is supplied to said primary combustion chamber, said feed door pivotally mounted to one of said walls.

21. The stove of claim 20 wherein said sheet is operatively connected to said feed door, whereby pivoting of said door rotates said sheet to an upright position thereby relieving pressure in said primary chamber when fuel is added thereto.

22. The stove of claim 1 wherein said flow diverter includes an inverted V-shaped baffle disposed between the secondary chamber and the smoke outlet.

* * * * *